US006609546B1

(12) United States Patent
Bobb et al.

(10) Patent No.: US 6,609,546 B1
(45) Date of Patent: Aug. 26, 2003

(54) FURNITURE WITH DISTRESSED APPEARANCE

(75) Inventors: Paul D. Bobb, Jamestown, NC (US); Mike Washburn, Trinity, NC (US); Brian K. Moore, Thomasville, NC (US)

(73) Assignee: Thomasville Furniture Industries, Inc., Thomasville, NC (US)

( * ) Notice: Subject to any disclaimer, the term of this patent is extended or adjusted under 35 U.S.C. 154(b) by 0 days.

(21) Appl. No.: 09/917,538

(22) Filed: Jul. 27, 2001

(51) Int. Cl.[7] ..... B27D 1/00

(52) U.S. Cl. ..... 144/346; 52/730.7; 144/133.1; 144/2.1; 144/134.1; 144/136.1; 144/345; 144/355; 144/371; 156/258; 156/304.5

(58) Field of Search ..... 156/219–257, 156/297, 220, 255, 258, 264, 304.5; 144/2.1, 3.1, 133.1, 134.1, 137, 136.1, 136.3, 345, 346, 350, 355, 371; 52/730.7; 29/559

(56) References Cited

U.S. PATENT DOCUMENTS

| | | | | | |
|---|---|---|---|---|---|
| 609,161 | A | * | 8/1898 | Nichols | 144/133.1 |
| 915,147 | A | | 3/1909 | Wood | |
| 1,113,798 | A | * | 10/1914 | Lohnes et al. | 144/133.1 |
| 1,637,164 | A | | 7/1927 | Talbot | |
| 2,353,794 | A | * | 7/1944 | Svikhart | 144/133.1 |
| 2,870,806 | A | * | 1/1959 | Thompson | 144/136.1 |
| 2,907,359 | A | * | 10/1959 | Lade | 144/136.1 |
| 4,546,806 | A | | 10/1985 | Dubuc | 144/345 |
| 4,853,062 | A | * | 8/1989 | Gartland | 156/219 |
| 4,930,556 | A | | 6/1990 | Prihoda | 144/347 |
| 4,945,959 | A | | 8/1990 | Biedenbach | 144/134.1 |
| 5,987,217 | A | | 11/1999 | Wisniewski et al. | 395/80 |

* cited by examiner

*Primary Examiner*—W. Donald Bray
(74) *Attorney, Agent, or Firm*—Womble Carlyle Sandridge & Rice, PLLC

(57) ABSTRACT

A process for creating a distressed surface for an article of furniture, and an article of furniture incorporating a distresses surface. The process includes the steps of selecting at least one piece of material having at least one planar surface and opposed side edges, mechanically forming grooves along at least one of the opposed side edges of the piece of material, and adjoining multiple pieces of material so formed to create a surface of an article of furniture that has a distressed appearance. The article of furniture includes a surface having a distresses appearance that is adhered to a substrate to create the face of the article of furniture.

31 Claims, 7 Drawing Sheets

FURNITURE WITH DISTRESSED APPEARANCE

FIELD OF THE INVENTION

The present invention relates to a method for creating a hand-crafted or distressed appearance on items of furniture. More particularly, the invention relates to a method for creating distressed surfaces and edges for incorporation into items of furniture.

BACKGROUND OF THE INVENTION

For centuries, wood has been the recognized and sought after material of choice for the construction of furniture. Although wood was an inexpensive material of construction for many years, the scarcity of most hardwoods has now made wooden furniture more expensive, particularly for selected hardwoods.

Over the years, furniture manufacturers have endeavored to create unique, rich-looking furniture collections that are appealing to a large number of buyers. Manufacturers have created price and quality ranges for home furnishings for nearly every price point in the market. Of particular interest and demand is furniture having a hand-crafted and hand-worn appearance. Antique furniture, for example, often contains the fingerprint of the furniture craftsman. Unique and random irregularities in the surface or the edges help make each piece special and valuable to the owner. Unfortunately, genuine antiques are limited in supply, and thus prohibitively expensive to most purchasers. Modem furniture techniques and materials can lead to the creation of furniture as good as, if not better than, that created by traditional hand methods. Nevertheless, customers desire the look of hand-crafted, combined with the better price that modern manufacturing techniques can yield.

Present-day manufacturers recognize the demand for antique furnishings and have sought to develop methods for creating new furniture that nonetheless has antique and handmade appearances. To do so, however, has been considerably challenging, involving a variety of labor intensive and costly techniques. For example, some manufacturers have chosen to purchase aged materials to form their furniture. Others have taken new materials and attempted to create distressed appearances thereon by manual means such as using rasps, files, chains, or other hand tools. One such approach induces unevenness or wear along the joints of adjoining veneer sheets. While wear would normally result from use over an extended period, unevenness in early handmade furniture often resulted from imprecision in assembly or unevenness in the cutting of materials by hand. An approach to simulate this unevenness and simulated wear along the joints of adjoining sheets is to chisel or gouge by hand the joint on assembled furniture faces. These labor-intensive processes, however, add significant costs to each item of furniture.

Thus, there remains a need for furniture having distressed appearances that are affordable to a larger segment of the market.

SUMMARY OF THE INVENTION

The present invention relates, in part, to a process for creating, in an economical fashion, surface members for articles of furniture, and the resulting furniture. The process begins with the selection of at least one piece of veneer, the piece having at least one planar surface and at least one edge.

Grooves are then formed along the edge of the planar surface. Once the forming process is complete, the veneer with grooves is suitable for assembling into an article of furniture to achieve a distressed appearance.

This and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

The present invention is directed to a method for creating surface members for articles of furniture as well as the furniture that incorporates the surface members.

Figure 1:
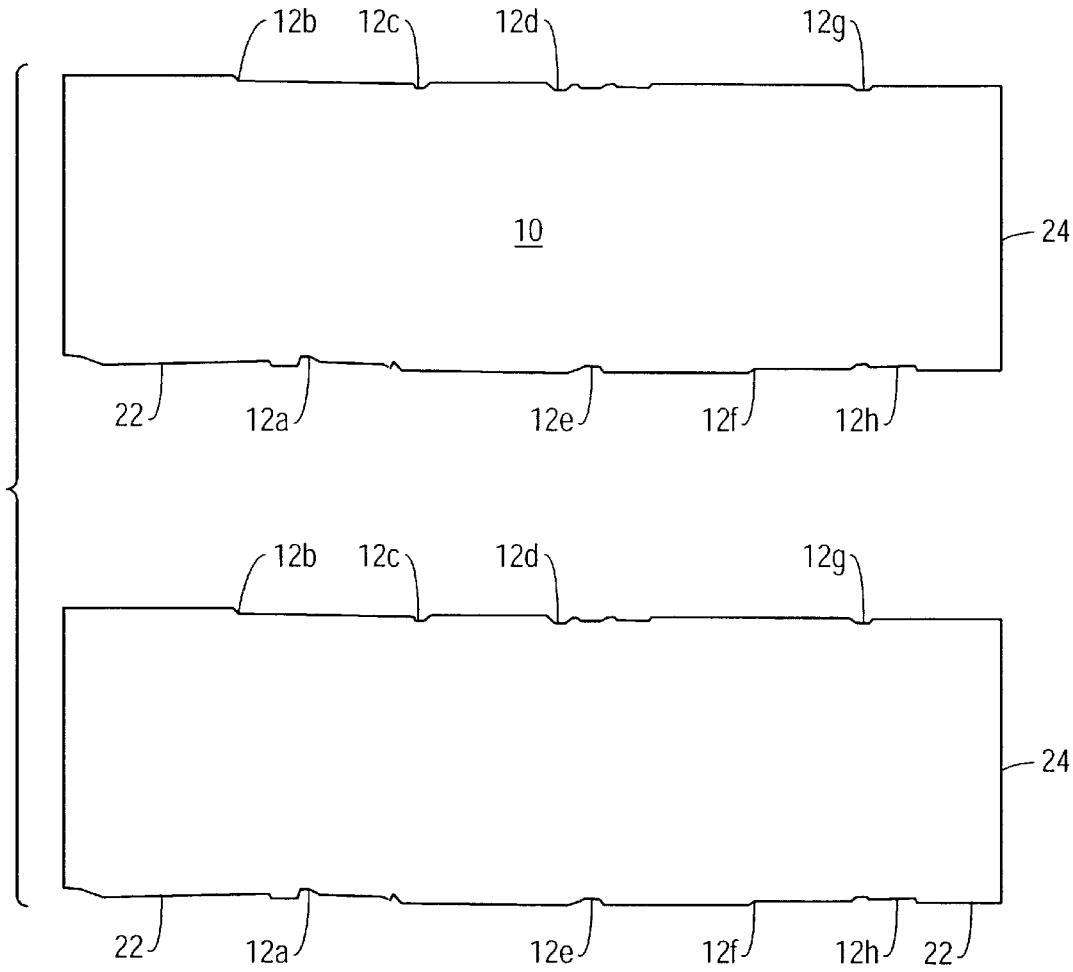
FIG. 1 is a top view of veneer sheets with edges formed according to the present invention.

As shown in FIG. 1, the present invention relates to sheets of face material, shown generally as 10, that are used to form the outer decorative surfaces of articles of furniture. As will be described in greater detail below, each sheet 10 is subjected to the forming process of the present invention to create notches, or grooves 12*a* through 12*h*, in opposed longitudinal edges 22 of sheet 10. Opposed edges 24 in FIG. 1 are not subjected to such forming, but may be. As used herein, "grooves" and "notches" refer to any discontinuity in an edge that is observable with the naked eye.

The first aspect of the present invention is directed to a process for creating the individual surface members for an article of furniture. The process begins with the selection of at least one piece of material having at least one planar surface and at least one side edge. In the preferred embodiment, this piece of material is an elongated wooden veneer sheet. As used herein, "veneer" refers to a thin layer of wood or other material for forming the facing or an inlay of a useful article, such as an item of furniture. Veneer sheets have been used for many years to form the outer coverings, or surfaces, of many different items of furniture. In the preferred embodiment, the sheets are cut from selected hardwoods; however, as those in the material arts will appreciate, composite wooden, non-wooden, and synthetic materials may be used to simulate solid wooden veneer surfaces and certainly are within the purview of the present invention. As those skilled in the art will appreciate, the thicknesses of the veneer sheets or other materials used are not critical to the present invention. While veneer sheets are often relatively thin as used on furniture faces, the materials used to form edge pieces according to the present invention may be substantially thicker. The veneer sheets can be composed of a hardwood such as olive ash burl. The sheets are conventionally known and generally purchased by furniture manufacturers in stacks of precut sheets known as "flitches." These flitches typically are 12 to 18 feet in length at the time of purchase. For workability, the long sheets are cut into multiple shorter lengths. In the present invention, the starting sheets for forming are approximately 3 inches wide, 42 inches in length, and 0.030 inches thick. These dimensions, while common in the furniture industry, are not critical to the present invention. Veneer sheets are conventionally cut this way so that they may be fitted together, like planks, to form tabletops, headboards, footboards, etc. for furniture. As those skilled in the art will appreciate, the dimensions of such sheets are not critical to the present invention.

Many attempts have been made to create veneer furniture faces having "distressed" appearances. As used herein, "distressed" refers to any of the many appearances that may be created in or on a veneer sheet to simulate hand-craftedness, age, wear, wormholes, bums, or abrasions.

Figure 2:
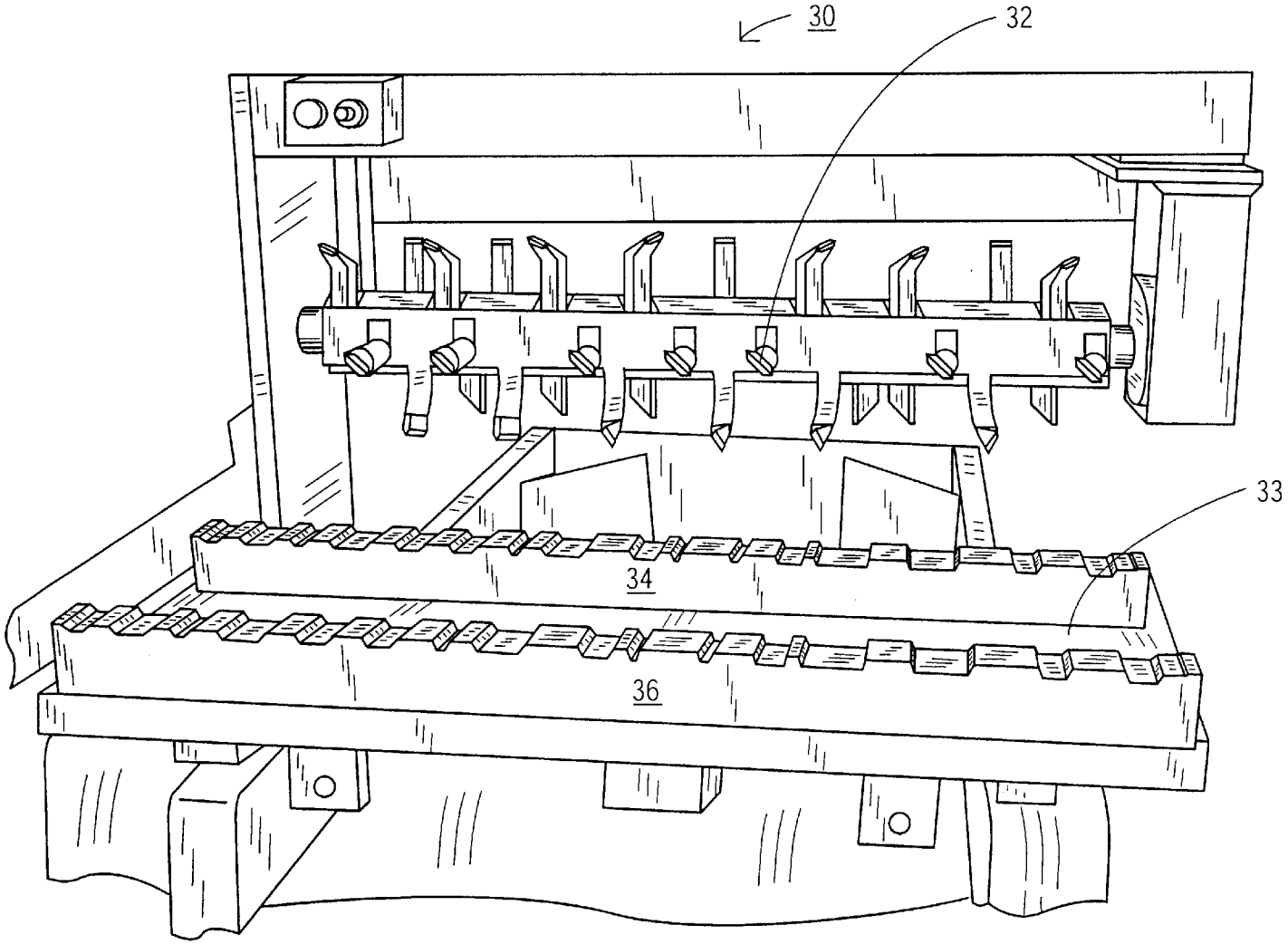
FIG. 2 is a front view of the profile planer with lathe head used to form the edges of the veneer sheets of FIG. 1.
Figure 3:
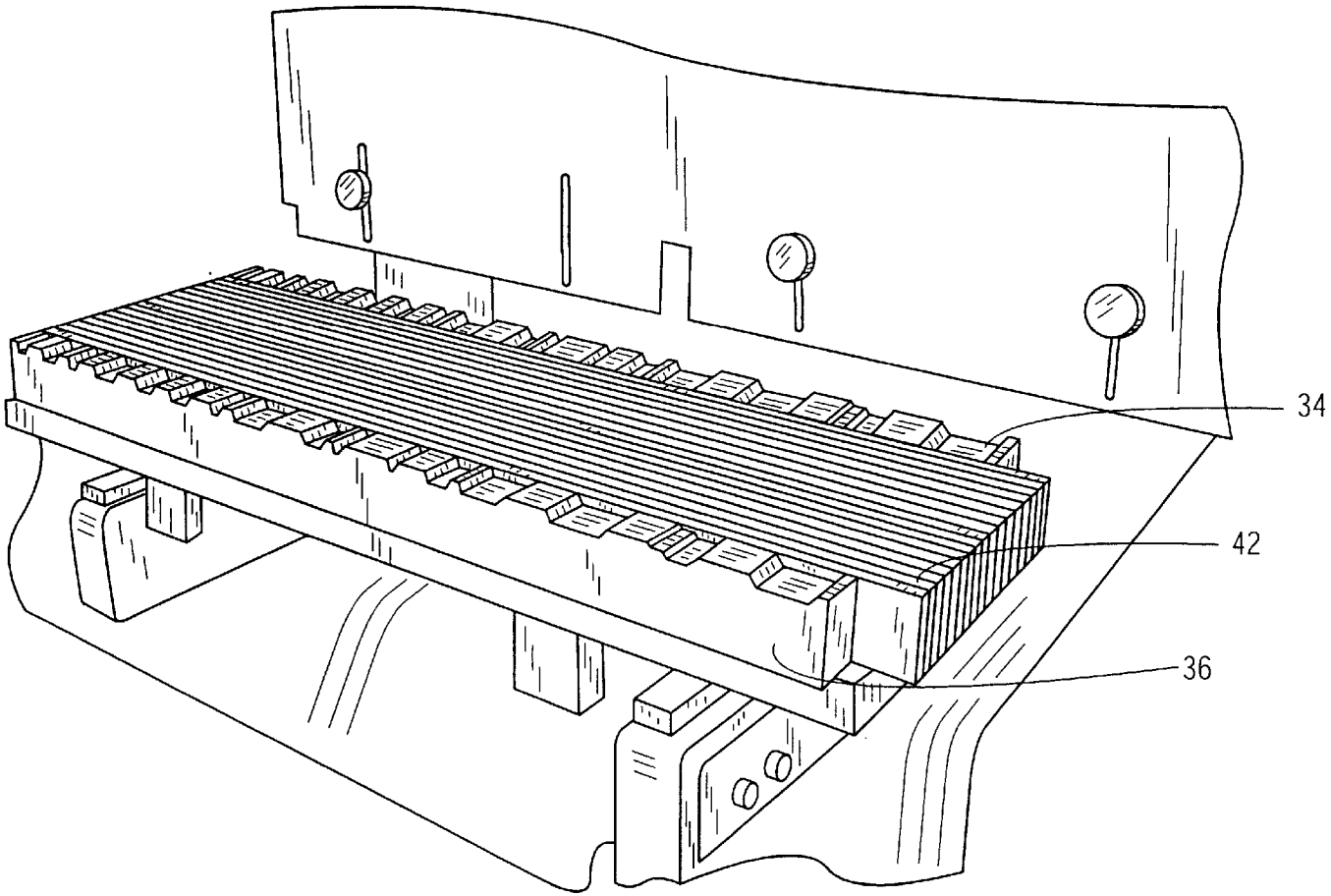
FIG. 3 is a front perspective view illustrating how veneer sheets are stacked in preparation for forming.

Referring now to FIGS. 2 and 3, the present invention is directed to an automated way of creating distressed joint edges along the sheets of wooden veneer. Shown generally as 30, a profile planner is used for the forming process. One suitable profile planer is manufactured by Bemco Machinery, Inc. of Jamestown, N.C. as Model 884. Profile planer 30 houses a rotating lathe head 32, wherein the head 32 includes a series of forming knives. The rotating head approximates the length of the stack of veneer sheets. The contours and lengths of the forming knives determine the particular pattern formed in an article. Profile planers like the one shown in FIG. 2 are intended for creating patterns in larger solid items such as chair seats or small table tops. Items to be so formed are secured on bed 33. Bed 33 is then driven into the path of the rotating head, where the knives create the desired pattern. Bed 33 is then withdrawn and the item removed.

Having selected the veneer sheets for the particular application, the sheets are next prepared for forming. It has been found that the sheets of veneer are most easily subjected to the forming, or distressing process, when stacked and pressed together. Specifically, it has been found that stacks of 300 or more of the veneer sheets may be formed at one time. This is accomplished by compressing the stack between vice-like members. In this way, the stack resembles a large solid piece of wood. As best seen in FIG. 3, a stack 42 of approximately 300 veneer sheets, each approximately 42 inches long, 3 inches wide, and 0.030 inches thick, are compressed between two vice-like holders 34 and 36. The compressed stack is oriented on the bed of the forming machine, such as the profile planer described above, with one longitudinal edge facing upward and one longitudinal edge against the bed. Bed 33 is then operatively driven inward beneath lathe head 32 where grooves, or notches, are formed along the upwardly facing horizontal edges of the stack 42, of sheets. The bed then retracts to the starting position. The stack of veneer sheets is then rotated so that the formed edges face downward against the bed and the left end of the stack becomes the right end of the stack. The bed is then again moved inward to subject the other longitudinal edges to the forming process. Once both edges have been formed, the stack is removed from the bed of the machine. Several thousand sheets can thus be formed within a single eight-hour shift. Referring again to FIG. 1, two sheets 10 from the same stack are shown after forming by lathe head 32. As demonstrated by these sheets, the forming knives of head 32 have created notches 12*a* through 12*h*. Notches 12*a* through 12*h*, respectively, are substantially identical in both sheets. To achieve notched edges that truly simulate worn or aged joints, the depth of notches 12 are from about 0.10 inches to 0.125 inches deep. Notches formed too deeply into the edges would defeat the desired appearance. Through trial and error, it has been found that a maximum depth of such notches or grooves is about 0.125 inches. So that notched sheets may be easily assembled in face patterns, straight, unnotched portions of edges 22 are necessary for evenly adjoining the formed sheets. While the same is true with edges 24, those skilled in the art will appreciate that grooves, or notches, along edges 24 will not defeat the appearance and are thus within the scope of the appended claims.

Figure 4:
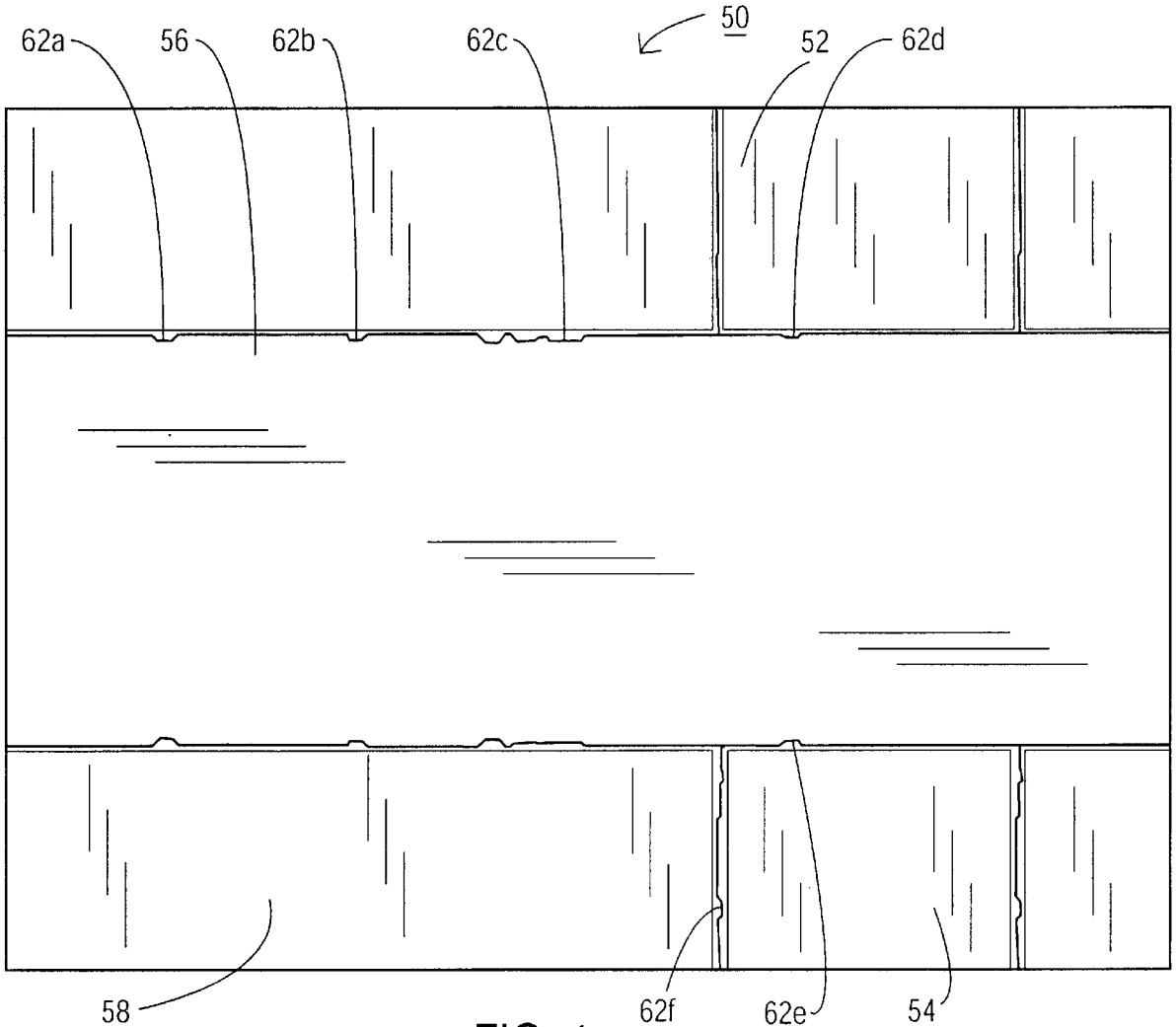
FIG. 4 is a close-up perspective view of a portion of a veneer face formed according to the present invention.
Figure 5:
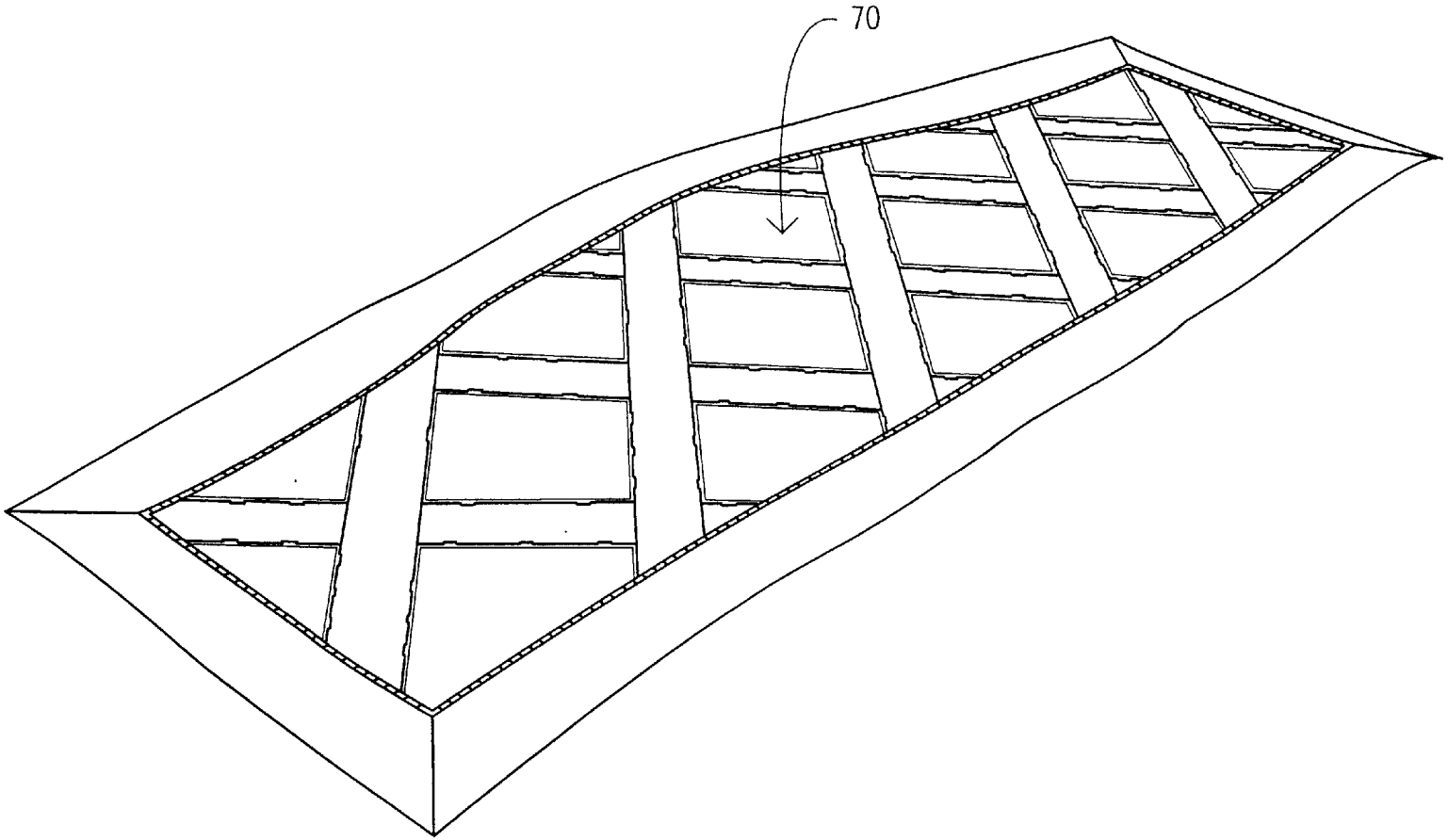
FIG. 5 is a perspective view of a veneer face formed according to the present invention.

A second aspect of the present invention is directed to a process for making an article of furniture having at least one surface that has a distressed, or worn, appearance. The process for forming the veneer sheets to be used on the surface is the same as described hereinabove. The formed sheets are cut to specific lengths and with desired angles for incorporation into any one of an unlimited number of surface patterns, such as parallel sections, cross-weaves, etc. The surface area of the particular pattern is dimensioned for the furniture surface to be covered. For example, if intended for a dining table, the pattern is sized and shaped to the approximate dimensions of the table top. Referring now to FIG. 4, there is shown a close-up view of a section 50 of a face pattern. Veneer sheet portions 52, 54, 56 are arranged in a crossed, or basket pattern, with adjoining inlays 58. Notches 62*a* through 62*f* are visible along the joints between the adjoined sheets. When creating a face for a table, headboard, footboard, etc., pieces of the face; e.g., veneer sheets and inlays, are aligned in the desired pattern and a masking tape (not shown) is applied on the outer side of the face. Thus, the face portion shown in FIG. 4 is the inner, or bottom, surface that will be adhered to the furniture substrate. Once the face is adhered to a substrate, the tape is peeled or sanded away. FIG. 5 is illustrative of a face for a headboard, with the inner, or bottom, surface facing upward.

Figure 6:
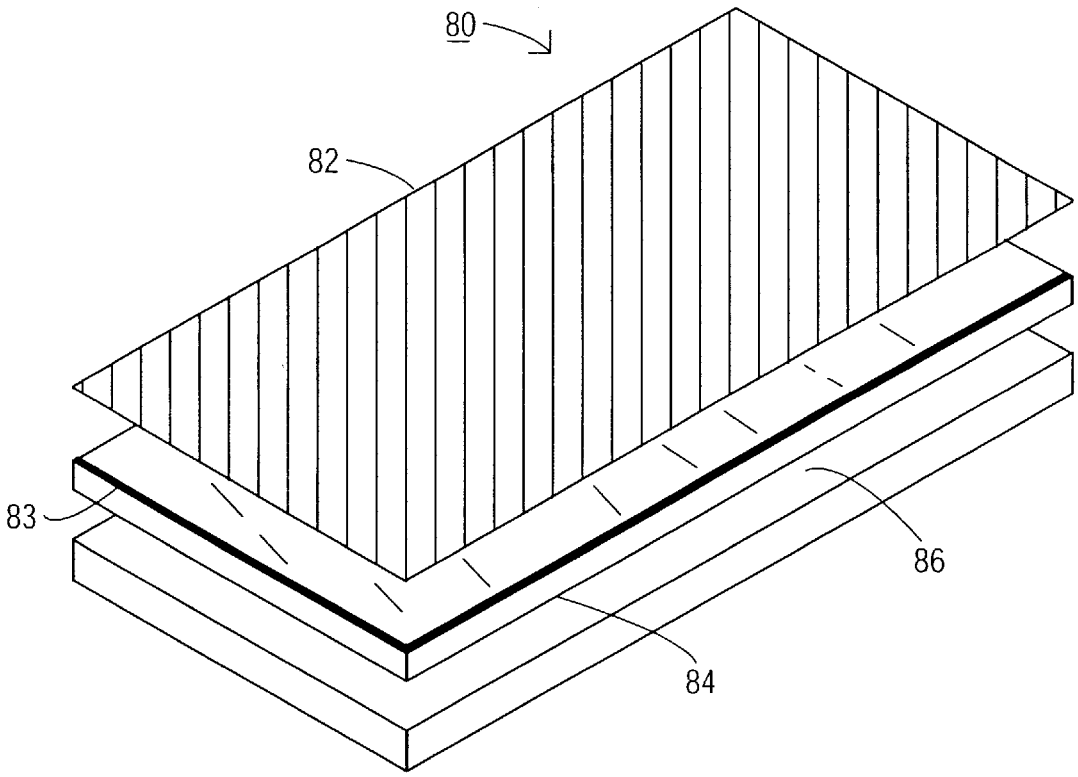
FIG. 6 is an exploded perspective view illustrating the components of a furniture surface.
Figure 7:
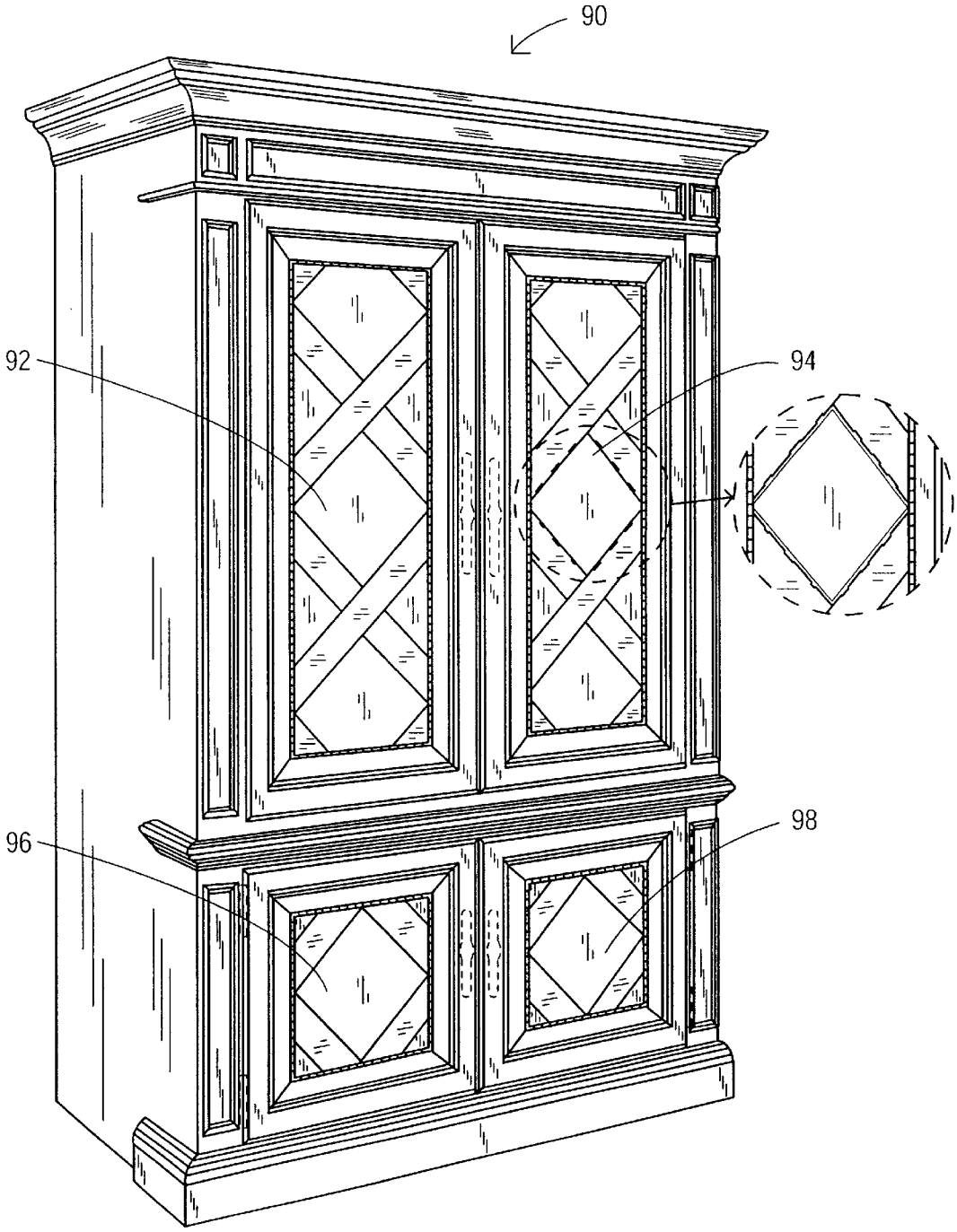
FIG. 7 is a perspective view of a completed article of furniture having front surfaces formed with veneer faces according to the present invention.

Once assembled, the pattern, or face, is adhered to a substrate that will form the principal structural element for the article of furniture. As seen in FIG. 6, the components of a furniture surface 80, such as a tabletop, are schematically illustrated. A face 82, constructed as described hereinabove, is adhered to an intermediate substrate 84. A suitable substrate 84 for the construction is Lebonite®, available from the Lebonite Corporation in Lebannon, Oreg. Substrate 84 is first prepared for receiving the face 82 by applying a dyed adhesive to the entire surface. The adhesive used for this application is a resin-based glue formed from a resin and catalyst mixture. Such resin-based glues are readily commercially available and widely known in the furniture industry. To highlight the distressed appearance of the furniture surface, a dark colored dye is mixed with the glue. The glue 83 is first applied to the substrate surface and then the face, or pattern, is affixed to the substrate over the glue. The dark colored glue is visible along the notched edges of the veneer sheets, creating an aged and worn appearance. One suitable glue is available from Borden Chemical in High Point, N.C. The glue is formed by mixing 1 part catalyst (Part No. FM505) with 8 parts resin (Part No. CR583). The black dye is then combined with the glue. A black dye available from AKZO Chemical of High Point, N.C. as Part No. 62-B5V-296 has been found acceptable for this purpose. Approximately 1 quart of dye is added to each 5-gallon container of resin glue. The glue is applied to substrate 84 at a thickness that approximates 25 to 30 grams per 1000 square feet of substrate surface area. Having applied the glue 83, the face 82 is positioned on and adhered to substrate 84. The black glue 83 partially fills the notches along joints in face 82. The substrate 84 and face 82 combination are next adhered to a final structural substrate 86 of particleboard with a resin based glue. Upon curing for approximately 72 hours at ambient temperature, the finished furniture face 80 is ready for incorporation into a larger furniture member and subsequent finishing with stains and protective coverings well known in the art. As used herein, "furniture member" refers, but is not limited to tables, beds, cabinets, etc. having at least one exposed face. As best seen in FIG. 7, a finished article of furniture 90 incorporates faces 92, 94, 96, and 98 into the front portion thereof.

Although identical notches are formed in each sheet of veneer formed as described above, the sheets are so placed in each pattern that similar notches are not readily apparent, except on close examination by someone who knows that similar notches may be found on the same face. Thus, the notches appear to be random and irregular as one would expect on a distressed, or antique piece of furniture.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

We claim:

1. A process for creating a distressed surface member suitable for an article of furniture, comprising:

(a) selecting at least one piece of veneer, the veneer having at least one planar surface with at least one edge; and (b) forming irregular grooves along the edge of the planar surface, wherein the veneer with irregular grooves is suitable for assembling into the article of furniture to achieve a distressed appearance.

2. The process of claim 1 further comprising, prior to the step of forming grooves, selecting at least a second piece of veneer to form a plurality of veneer sheets, combining the plurality of veneer sheets in a stack to allow for forming grooves along the edges of the planar surfaces of each of the plurality of veneer sheets during the same forming operation.

3. The process of claim 2 wherein said grooves are produced by a non-hand powered tool.

4. The process of claim 3 wherein said non-hand powered tool is a lathe rotatably mounted in a forming machine.

5. The process of claim 1 wherein the veneer is wood selected from the group consisting of hickory and pecan.

6. The process of claim 1 wherein the grooves have a depth of from about 0.10 to 0.125 inches.

7. A process for creating a distressed surface member suitable for an article of furniture, comprising:

(a) selecting at least one substantially planar piece of material, the piece of material having at least one edge; and (b) forming irregular grooves along the edge of the piece of material, wherein the piece of material with irregular grooves is suitable for assembling into the article of furniture to achieve a distressed appearance.

8. The process of claim 7 further comprising, prior to the step of forming grooves, selecting at least a second piece of material to form a plurality of pieces, combining the plurality of pieces in a stack to allow for forming grooves along the edges of each of the plurality of pieces during the same forming operation.

9. The process of claim 8 wherein said grooves are produced by a non-hand powered tool.

10. The process of claim 9 wherein said non-hand powered tool is a lathe rotatably mounted in a forming machine.

11. The process of claim 7 wherein the veneer is wood selected from the group consisting of hickory and pecan.

12. The process of claim 7 wherein the grooves have a depth of from about 0.10 to 0.125 inches.

13. A process for creating a distressed furniture surface, comprising:

(a) selecting at least one piece of veneer, the veneer having at least one planar surface with at least one edge;

(b) forming irregular grooves along the edge of the planar surface, wherein the veneer with irregular grooves is suitable for assembling into the article of furniture; and (c) adjoining a plurality of veneer pieces to create a face for the article of furniture, the face having a distressed appearance.

14. The process of claim 13 further comprising, prior to the step of forming grooves, selecting at least a second piece of veneer to form a plurality of veneer sheets, combining the plurality of veneer sheets in a stack to allow for forming grooves along the edges of the planar surfaces of each of the plurality of veneer sheets during the same forming operation.

15. The process of claim 14 wherein said grooves are produced by a non-hand powered tool.

16. The process of claim 15 wherein said non-hand powered tool is a lathe rotatably mounted in a forming machine.

17. The process of claim 14 wherein the veneer is wood selected from the group consisting of hickory and pecan.

18. The process of claim 13 wherein the grooves have a depth of from about 0.10 to 0.125 inches.

19. The process of claim 13 further comprising the step of adhering the face to a substrate with a colored glue.

20. An article of furniture with at least one surface thereof having a distressed appearance, said article of furniture formed by the steps comprising:

(a) selecting at least one piece of veneer, the veneer having at least one planar surface with at least one edge;

(b) forming irregular grooves along the edge of the planar surface, wherein the veneer with irregular grooves is suitable for assembling into the article of furniture;

(c) adhering a plurality of veneer pieces with irregular grooves to a substrate to create the face for the article of furniture, the face having a distressed appearance; and (d) incorporating the face having a distressed appearance into a furniture member.

21. The process of claim 20 further comprising, prior to the step of forming grooves, selecting at least a second piece of veneer to form a plurality of veneer sheets, combining the plurality of veneer sheets in a stack to allow for forming grooves along the edges of the planar surfaces of each of the plurality of veneer sheets during the same forming operation.

22. The process of claim 21 wherein said grooves are produced by a non-hand powered tool.

23. The process of claim 22 wherein said non-hand powered tool is a lathe rotatably mounted in a forming machine.

24. The process of claim 20 wherein the plurality of sheets are adhered to the substrate with a colored glue.

25. A veneer for use in furniture that creates a distressed appearance comprising:

(a) a planar piece of veneer, the piece of veneer having at least one edge; and (b) a plurality of irregular grooves formed on the at least one edge, the irregular grooves being formed in a non-random pattern.

26. The veneer of claim 25 wherein the veneer is wood selected from the group consisting of hickory and pecan.

27. The veneer of claim 25 wherein the grooves have a depth of from about 0.10 to 0.125 inches.

28. The process of claim 25 wherein said grooves are produced by a non-hand powered tool.

29. The process of claim 28 wherein said non-hand powered tool is a lathe rotatably mounted in a forming machine.

30. A process for creating a distressed surface member suitable for an article of furniture, comprising:

(a) selecting a plurality of wooden veneer pieces, each veneer piece having at least one planar surface with at least one edge;

(b) combining and pressing together the plurality of veneer sheets into a stack; and (c) forming irregular grooves along the edges of the veneer sheets in the stack, each of said irregular grooves having a depth of from about 0.10 to 0.125 inches formed by a lathe rotatably mounted in a forming machine, wherein the veneer pieces with irregular grooves are suitable for assembling into a face for an article of furniture, said face having a distressed appearance.

31. An article of furniture with at least one surface thereof having a distressed appearance, said article of furniture comprising:

(a) a face portion formed from a plurality of adjoined veneer pieces, each of said veneer pieces having irregular grooves formed on at least one edge in a non-random pattern to create a distressed appearance;

(b) a substrate for adhesively attaching the face portion thereto; and (c) a furniture member incorporating said substrate and attached face portion therein.

* * * * *